US006637361B1

(12) United States Patent
Hörkkö

(10) Patent No.: US 6,637,361 B1
(45) Date of Patent: Oct. 28, 2003

(54) CONNECTING DEVICE FOR A PUSH-BARGE SYSTEM

(76) Inventor: Tuija Arja Tuulikki Hörkkö, Mäkikatu 39, FIN-26200 Rauma (FI)

( * ) Notice: Subject to any disclaimer, the term of this patent is extended or adjusted under 35 U.S.C. 154(b) by 0 days.

(21) Appl. No.: 10/029,838

(22) Filed: Dec. 31, 2001

(51) Int. Cl.[7] ..... B63B 21/58
(52) U.S. Cl. ..... 114/249; 114/248
(58) Field of Search ..... 114/242, 248, 114/249, 251, 253

(56) References Cited

U.S. PATENT DOCUMENTS

| | | | | |
|---|---|---|---|---|
| 3,842,603 A | * | 10/1974 | Ditzen | 60/416 |
| 5,050,522 A | * | 9/1991 | Yamaguchi et al. | 114/248 |
| 5,072,685 A | * | 12/1991 | Kaucic | 114/249 |
| 5,613,537 A | * | 3/1997 | Gassiott | 144/218 |
| 6,129,001 A | * | 10/2000 | Harju | 91/397 |

FOREIGN PATENT DOCUMENTS

| | | |
|---|---|---|
| FI | 103777 | 10/1995 |

* cited by examiner

*Primary Examiner*—Stephen Avila
(74) *Attorney, Agent, or Firm*—James C. Lydon

(57) ABSTRACT

A connecting device for a push-barge system in which an engine driven pusher vessel is connected to a pushed barge vessel, the connecting device including a cylinder in combination with a piston, the cylinder being fastened to a side of the pusher vessel and operated by a pressure medium, and a counterpart connected to barge vessel and to which a connecting member is connected due to the effect of the movement of the piston of the cylinder, where the connecting device includes a pressure restricting valve through which the pressure medium can be discharged from the cylinder when, due to the effect of mutual approaching movement between the barge vessel and the pusher vessel, the counterpart transmits to the piston via the connecting member a force, which is so high that the pressure caused by the piston will at least partially open the pressure restricting valve.

8 Claims, 2 Drawing Sheets

CONNECTING DEVICE FOR A PUSH-BARGE SYSTEM

The invention relates to an improved connecting device for a push-barge system according to the preamble of the independent claim 1, with which connection device an engine driven vessel, a pusher, is connected to the pushed vessel, a barge.

A large number of pushers and push-barges as well as their connecting devices are known. The publication U.S. Pat. No. 20,944 presents a solution where the connection between the pusher and the barge can be adjusted to different levels according to whether the barge is loaded or not. U.S. Pat. No. 3,486,476 presents a connection apparatus which uses wires between the pusher and the barge as connection members. The vessels are also connected to each other with the aid of a side list and a groove. The publication U.S. Pat. No. 3,610,196 presents a connection manner between a pusher and a barge which uses hydraulically movable locking bars as connecting members. However, the connection height between the pusher and the barge is not selectable, which in many cases is considered to be a disadvantage. The publication U.S. Pat. No. 3,844,245 presents a connection apparatus for a pusher and a barge where the pusher has on its sides connection members to be pushed into grooves in the inner sides of the stern of the barge. Wedge-like connection members receive a good support from corresponding connection points, but the connection becomes very rigid, which can be a poor characteristic in some sea conditions. U.S. Pat. No. 5,055,323 presents a connection structure of a pusher and a barge, where a hydraulic cylinder pair mounted in the pusher moves a quite massive locking body, which is pushed into notches located in the barge. However, the apparatus has a very heavy structure and it is rather complicated, and applicable only for a fixed connection. The publication FI 103777 presents a connecting device of a push-barge system where the connection between the pusher and the barge is made with the aid of cylinder packages operated by a pressure medium, so that the end of the piston rod of the cylinder extends into a cup-like counterpart in the barge. If the used pressure medium is compressed air the connection is able to yield in rough sea, which can be considered an advantage. However, there is not presented any adjustment of the apparatus, which may be regarded as a disadvantage, because it should be possible to be able to adjust the flexibility of the connection in different sea conditions.

The object of the invention is to present an improved connecting device for a push-barge system which can be adjusted so that when the pusher and the barge approach each other, then the piston rod of the cylinder is able to move due to the forces between the vessels when said force exceeds a set level. In rough sea the motions of the pusher are then more even, and the crew will not experience the blows from the barge as unpleasant as when the connection is rigid. An object of the invention is also to utilise the pneumatic system of the pusher as the energy source, so thus no extra machinery is required.

The object of the invention is attained in the manner presented in the independent claim 1 and in the other claims. According to the invention the push-barge system uses an improved connecting device with which the engine driven vessel, a pusher, is connected to the pushed vessel, a barge. The connecting device includes a cylinder, which is fastened to the side of the pusher and which with its piston is operated by a pressure medium, and a counterpart, which is fastened to the barge and into which a connecting member connected to the piston is being supported due to the movement of the piston of the cylinder. The connecting device comprises a pressure restricting valve or the like through which the pressure medium can be discharged from said cylinder when, due to the effect of the mutually approaching movement between the barge and the pusher, said counterpart transmits to the piston via the connecting member a force, which is so high that the pressure caused by the piston will at least partially open the pressure restricting valve. Then the connection between the pusher and the barge can be made flexible, and then the movements of the pusher and the barge in rough sea will not be blow-like in the same way as in a rigid or almost rigid connection. As the crew of the pusher can adjust the operating limit of the pressure restricting valve it can be chosen so that it is more suitable, regarding the sea, the wind, the loading of the barge, the speed, as well as the characteristics and the size of the barge. The use of the device according to the invention will improve the working conditions of the crew in the pusher, and will also reduce the disadvantages caused to the vessel by a rough sea.

If said pressure restricting valve is adjustable, then the adjustment can be made any time and quite easily.

If the counterpart fastened to the barge is fastened to the board structure of the barge by welding or by bolted joints, then the fastening can be done for instance as a post-installation quite rapidly, and even then a sufficiently robust connection can be obtained.

If the connecting device receives its operating energy from the pneumatic system of the pusher, which provides compressed air with which the hydraulic oil of the connecting device is pressurised, then there is no need for a hydraulic machinery or a corresponding apparatus, as the pneumatic system of the pusher has a quite sufficient capacity for the energy supply to the connecting device according to the invention.

If there is an adjustable connecting device on both sides of the pusher, then the pusher can be adjusted regarding both sides, and regardless of the direction of the sea compared to the travelling direction.

If said pressurised medium is an almost non-compressible matter, such as hydraulic oil or the like, then the operation of the apparatus will experience no disadvantages caused by compression.

If the end of the piston rod is a cylindrical connecting member, or if such one is fastened to the end, which member can find suitable space to engage in the cylindrical notch of the counterpart, then the connecting joint will be simple and reliable at the same time.

The invention is presented in more detail below with reference to the enclosed drawing, in which FIG. 1 shows schematically an improved connecting device of a push-barge system according to the invention, in the form of a basic diagram;

Figure 1:
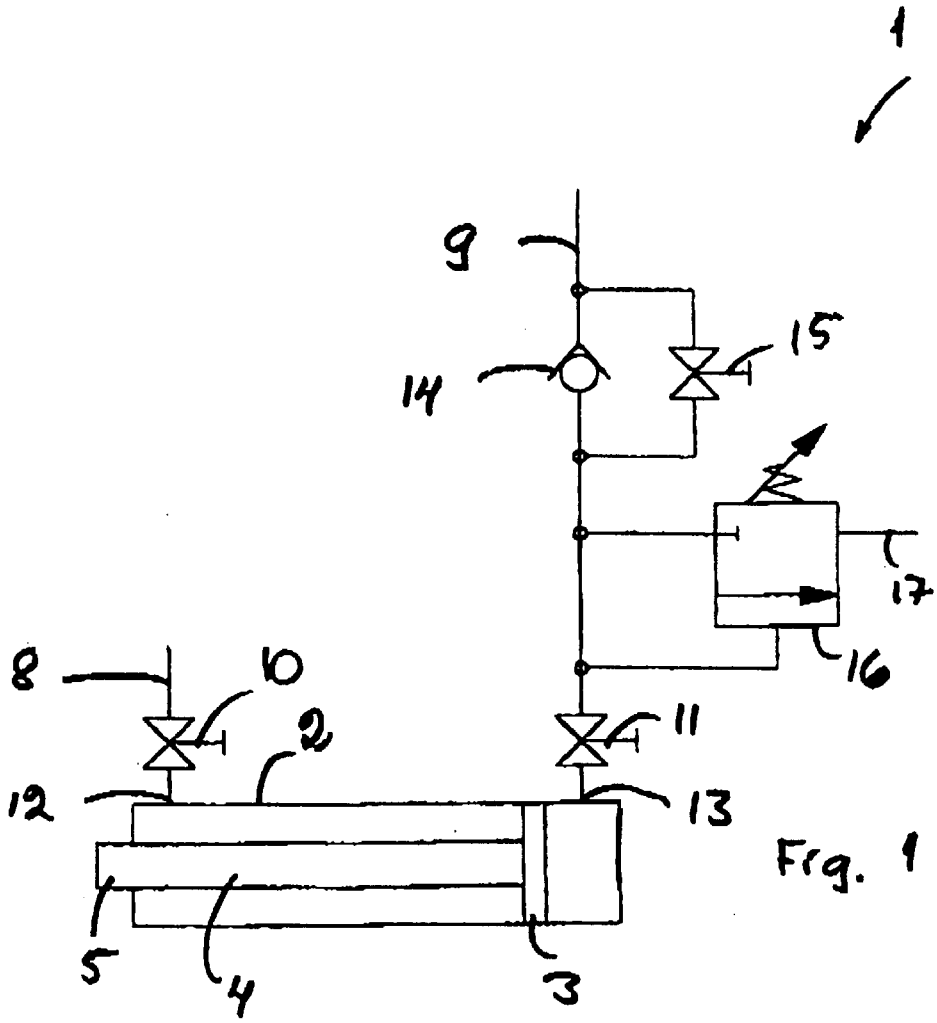
Figure 4:
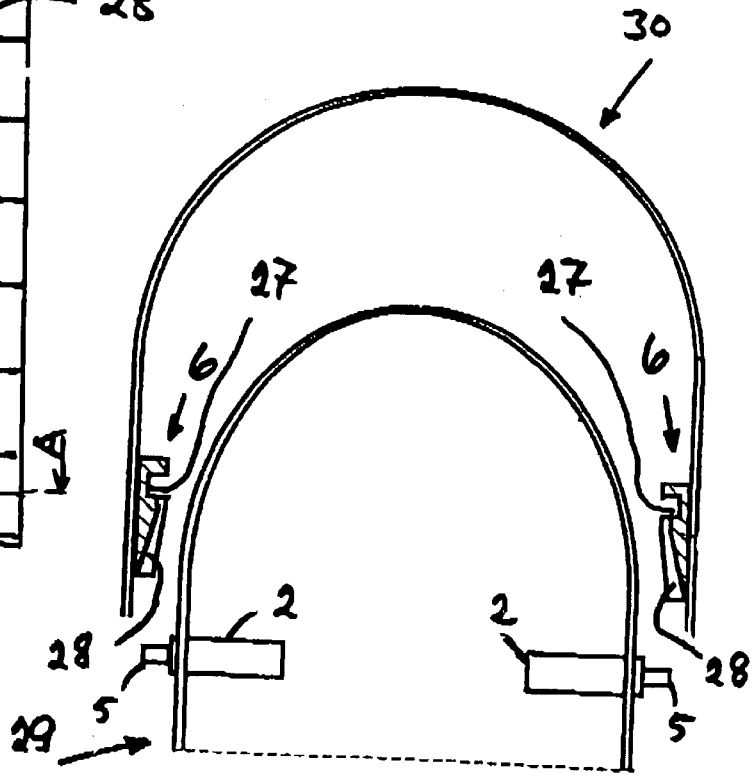
FIG. 4 shows schematically a pusher and a barge close to each other, but before the connection.

In FIG. 1 the reference numeral 1 refers to the improved connecting device of a push-barge system according to the invention in the form of a basic diagram. The cylindrical end 5 on the piston rod 4 of the piston 3 of the cylinder 2 acts as a connecting member, which in the connection presented in FIG. 4 is within the counterpart 6. The piston rod 4 is considerably thick, usually its diameter is 300 to 700 mm, so that it shall withstand the forces acting on it, also in rough sea. The cylinder 2 is a double-acting cylinder, where the piping connections, the connections 12 and 13, are close to the ends of the oil chambers of the cylinder 2. The construction of the cylinder 2 is explained in more detail in FIG. 2. The reference numerals 8 and 9 in FIG. 1 show the input pipes for oil at the pneumatic pressure (normally 15 to 30 bar). Usually both of these pipes have the same pressure. Valves 10 and 11 are mounted in the connections 12 and 13 of the cylinder 2, or close to them, whereby these valves locally can completely close said connections of the cylinder 2. Normally the device according to the invention is remotely controlled from the bridge of the pusher via a pneumatic panel (not shown) located outside the figure. The valves 10 and 11 are mainly intended for situations of maintenance and repair. In front of the valve 11 in the input pipe 9 there is a back valve 14, and in parallel with it a by-pass valve 15, and further there is a pressure reduction valve 16, which can be remotely controlled. The oil which flows through the pressure reduction valve 16 is returned to the system along the pipe 17.

Figure 2:
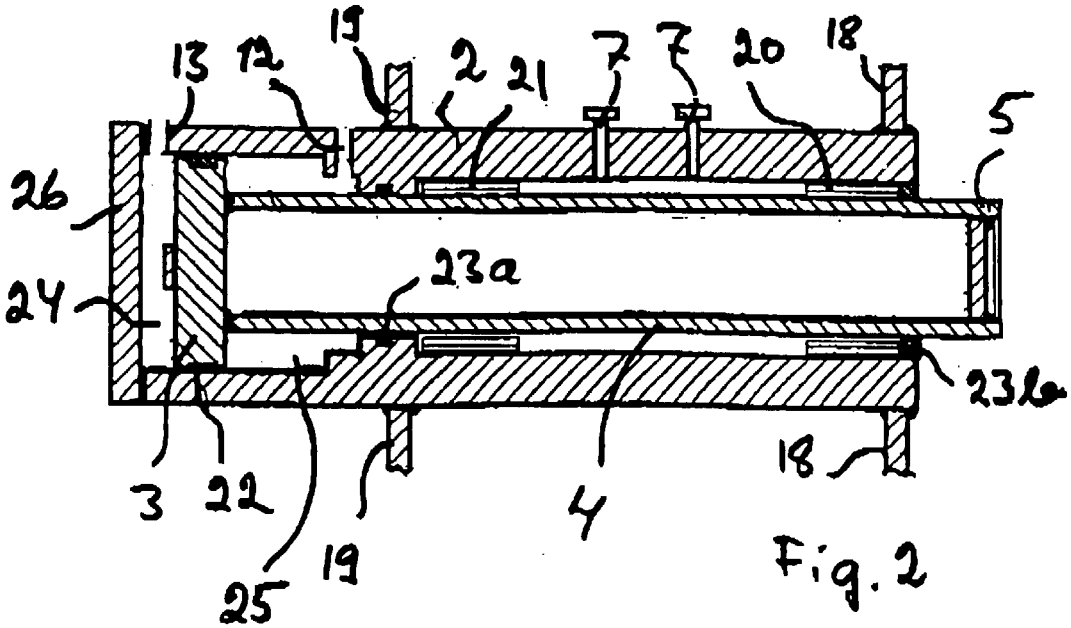
FIG. 2 shows schematically the cylinder as well as its piston and its piston rod of the connecting device according to FIG. 1, and the connection to a pusher in a cross section.

FIG. 2 shows in more detail and as a cross section the cylinder 2 with its rod 3 and cylindrical piston rod 4 in the connecting device according to FIG. 1, and the connection to the pusher. The walls of the cylinder are quite thick, and the whole cylinder 2 is fastened to the side 18 of the pusher and to a reinforcing structure 19 which is mounted to the side, either by welding or with the aid of bolted joints. In order to reach a sufficient strength the distance between the side 18 and the reinforcing structure should be sufficiently large, preferably at least 0.9 m. In FIG. 2 the piston rod 4 is essentially longer than the length of the movement of the piston 3. This is necessary because the piston rod 4 is guided by two bearings 20 and 21 which are located far apart, and this length is required in order to make the bearings to receive that transversal force which due to different reasons occurs in the connection between the pusher and the barge. For instance regarding its seals the cylinder 2 is of a conventional design, which is not described more extensively here. The piston 3 has a piston seal 22, a seal between the piston rod 4 and the wall of the cylinder 2 represented by the reference numeral 23*a*, and a seal or seals 23*b* at the end of the cylinder 2 acting against the effects of splash water and as a seal of the oil space of the bearings 20 and 21. The reference numeral 7 represents sensors, with the aid of which real-time information about the position of the piston rod can be shown at the station of the operator. The connections 12 and 13 are close to the ends of the movement of the piston 3. The oil space at the connection 13 is represented by the reference numeral 24, and the oil space on the other side of the piston is represented by the reference numeral 25. The diameter of the piston rod 4 is considerably thick due to the strength requirements, in practice generally 80 to 90% of the diameter of the piston 3. When the barge pushes against the end 5 of the piston rod 4 the force is transferred via the piston rod 4 to the piston 3, which begins to move against the end 26 of the cylinder 3. Because the hydraulic oil is in practice a completely non-compressible liquid, the oil will pass through the connection 13 out from the oil space 24, and if the valve 11 is open, then to the pressure reduction valve 16 which is at least partly opened if it is adjusted to open already at this prevailing pressure. Due to the effect of said force the pressure may in practical applications rise in the oil space 24 even to a pressure of 200 bar or more. In practical applications the piston movement is only a few millimetres when the distance between the pusher and the barge decreases.

The valve 15 is usually kept closed, so that said oil flow can not reach the input pipe 9 due to the back valve 14. When the piston 3 has moved the pressurised oil can flow from the input pipe 8 through the open valve 10 and the connection 12 to the oil space 25. When the pushing effect of the barge against the end 5 of the piston rod 4 decreases, then the pressure reduction valve 16 is closed due to the lowered pressure, and the pressurised hydraulic oil begins to flow from the input pipe 9 through the back valve 14 and the valve 11 into the oil space 24. Because due to the pressure reduction valve 16 there is a flexible connection between the pusher and the barge, the connecting device according to the invention will reduce, or at least limit the blows between the pusher and the barge in rough sea, which blows are generally perceived quite unpleasant by the crew of the pusher. All parts having an effect on the operation should be dimensioned to be sufficiently durable even in a rough sea, and moreover also to have sufficiently large movement paths. Also the dimensioning of the hydraulic oil pipes, the valves and the connection is important in order to enable the hydraulic oil to flow sufficiently fast in the apparatus.

If there is no swell, then the valves 10 and 11 can be closed manually, whereby the connection between the pusher and the barge is virtually immobile in the transversal direction, and whereby it is for instance possible to repair the piping during a voyage. If the operating range of one pressure restricting valve 16 is too narrow, then it is possible to use two pressure restricting valves instead of one, so that the valves have different, preferably overlapping control ranges. In this manner it is possible to use the first one in moderate sea and the second one in rough sea. The pressurised hydraulic oil can be generated in a way known as such, and in a conventional hydraulic machinery with the aid of an electric motor and a pump, or in some other way known as such, of which it is very recommendable to pressurise with the aid of operating energy derived from the compressed air system of the pusher (not shown). Here it is possible to use i.a. solutions known as such, such as a cylinder (not shown), to which compressed air is supplied on the first side of the piston, and where the second side of the piston contains hydraulic oil to be used in the connecting device according to the invention and to be supplied to the pipes 8 and 9.

Figure 3:
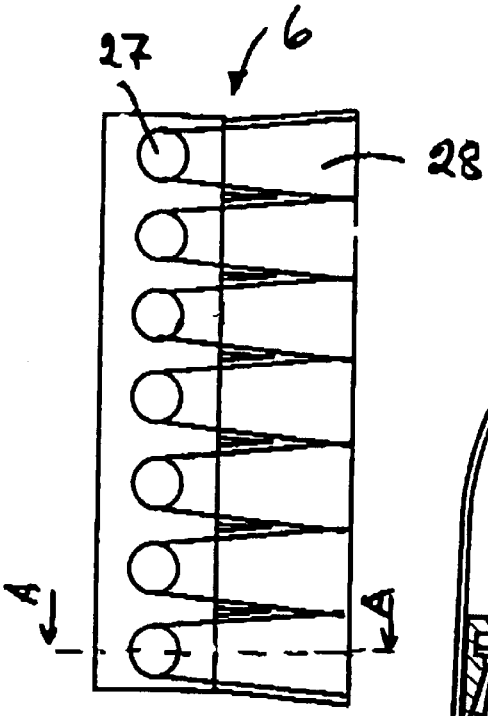
FIG. 3 shows schematically the counterpart mounted in a barge.

FIG. 3 shows a counterpart 6 known as such to be mounted in a barge, the counterpart having a plurality, for instance 7 cup-like notches 27 with a depth of about 20 cm. The ramp 28 towards the notch 27 tapers and rises upwards, so that the counterpart 6 can be mounted at the stern of the barge 30, either as a surface installation, or built-in into the sideboard of the fork of the barge.

FIG. 4 shows the bow of the pusher 29 and the stem of the barge as they are close to each other, but before they are connected. The counterparts 6 are shown as cross-sections in the section A—A of FIG. 3.

Figure 5:
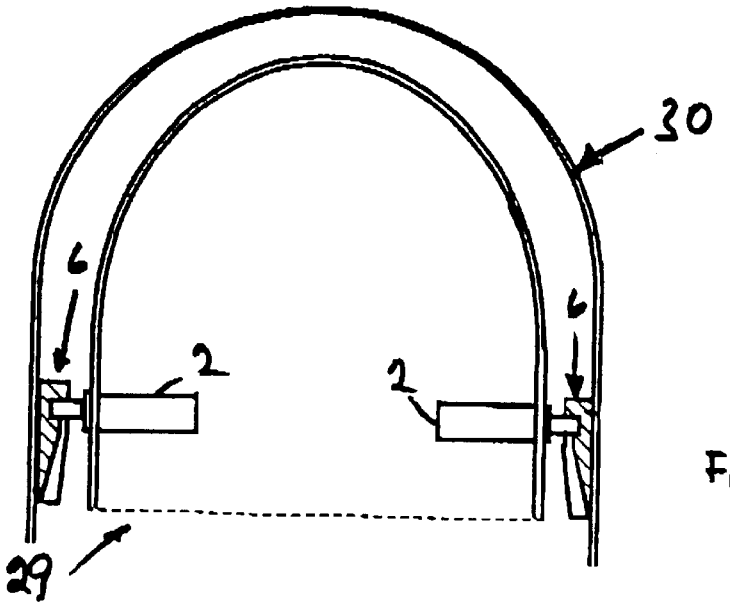
FIG. 5 shows schematically a pusher and a barge connected to each other.

FIG. 5 shows the pusher 29 and the barge 30 connected to each other with the aid of a connecting device according to the invention. The pusher 29 is located centrally in the stern opening of the barge 30, whereby the ends 5 of the piston rods 4 are located in the cup-like notches 27. Thus the pusher 29 can push the barge 30. It is also possible to move the pusher 29 to abut either side of the barge 30, as the connection of the devices on both the left and right sides can be controlled individually.

The invention is not limited to the enclosed embodiment but a number of modifications are conceivable within the scope of the enclosed claims.

What is claimed is:

1. An improved connecting device for a push-barge system, wherein an engine driven pusher vessel is connected to a pushed barge vessel, said connecting device including a cylinder in combination with a piston, the cylinder being fastened to a side of the pusher vessel and operated by a pressure medium, and a counterpart connected to said barge vessel and to which a connecting member is connected due to the effect of the movement of the piston of the cylinder, wherein the connecting device includes a pressure restricting valve through which the pressure medium can be discharged from said cylinder when, due to the effect of the mutual approaching movement between the barge vessel and the pusher vessel, said counterpart transmits to the piston via the connecting member a force, which is so high that the pressure caused by the piston will at least partially open the pressure restricting valve.

2. The connecting device of claim 1, wherein said pressure restricting valve is adjustable.

3. The connecting device of claim 1, wherein the counterparts fastened to the barge vessel is fastened to a side structure of the barge vessel by welding or by bolted joints.

4. The connecting device of claim 1, wherein the connecting device receives its operating energy from the pneumatic system of the pusher vessel, which provides compressed air with which the hydraulic oil of the connecting device is pressurized.

5. The connecting device of claim 1, further comprising an adjustable connecting device in both sides of the pusher vessel.

6. The connecting device of claim 1, wherein said pressurized medium is an almost non-compressible matter.

7. The connecting device of claim 6, wherein said pressurized medium comprises hydraulic oil.

8. The connecting device of claim 1, wherein the end of the piston rod is a cylindrical connecting member, or such a cylindrical connecting member is fastened to the end, which member can find suitable space to engage in the cylindrical notch of the counterpart.

* * * * *